US005819787A

United States Patent [19]

Caparros

[11] Patent Number: 5,819,787

[45] Date of Patent: Oct. 13, 1998

[54] APPARATUS AND PROCESS FOR SAFELY CONTAINING AND DELIVERING HAZARDOUS FLUID SUBSTANCES FROM SUPPLY CYLINDERS AND CYLINDER LOADING STRUCTURE

[76] Inventor: Rudolph Caparros, 3641 Turnberry Cir., Sante Rosa, Calif. 95430

[21] Appl. No.: 652,634

[22] Filed: May 22, 1996

Related U.S. Application Data

[63] Continuation-in-part of Ser. No. 901,606, Jul. 12, 1995, Pat. No. 5,607,384.

[51] Int. Cl.[6] ..... A62D 3/00; A62D 83/38; A62D 83/44; B65D 83/54

[52] U.S. Cl. ..... 137/377; 137/312; 137/340; 220/422; 588/249; 588/259; 588/260; 588/900

[58] Field of Search ..... 588/249, 259, 588/260, 900; 137/340, 343, 377, 312; 414/292; 220/422, 901

[56] References Cited

U.S. PATENT DOCUMENTS

| | | | |
|---|---|---|---|
| 4,390,040 | 6/1983 | Beyen | 137/340 |
| 4,690,180 | 9/1987 | Gold | 588/900 X |
| 5,086,804 | 2/1992 | Noai | 137/312 |
| 5,254,798 | 10/1993 | Zoback | 588/259 |
| 5,410,121 | 4/1995 | Schlienger | 588/900 X |
| 5,569,151 | 10/1996 | Karwacki | 588/249 |
| 5,588,461 | 12/1996 | Plecnik | 137/312 |
| 5,607,384 | 3/1997 | Caparros | 588/259 |

*Primary Examiner*—George A. Suchfield
*Attorney, Agent, or Firm*—Frank L. Kubler

[57] ABSTRACT

An apparatus for safely delivering a hazardous fluid substance to a receiving structure includes a supply cylinder containing a hazardous fluid substance and having a supply cylinder release port; a high pressure containment vessel having a vessel wall and a vessel receiving end, for receiving and safely enclosing the supply cylinder; a conduit structure in fluid communication with the supply cylinder and with the receiving structure for delivering the hazardous fluid substance from the supply cylinder into the receiving structure; and a supply cylinder loading structure for loading the supply cylinder into the containment vessel, including a containment vessel pivoting assembly having a structure for tilting the containment vessel into a substantially horizontal position and a supply cylinder pivoting assembly having a structure for tilting the supply cylinder into a substantially horizontal position for sliding the supply cylinder into the vessel receiving end.

11 Claims, 5 Drawing Sheets

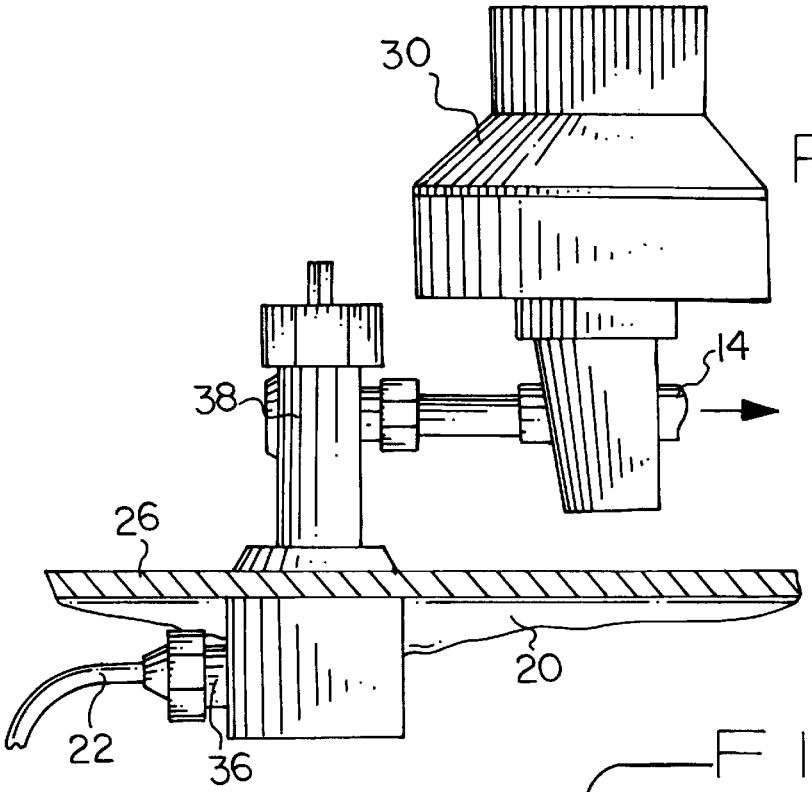
FIG. 3
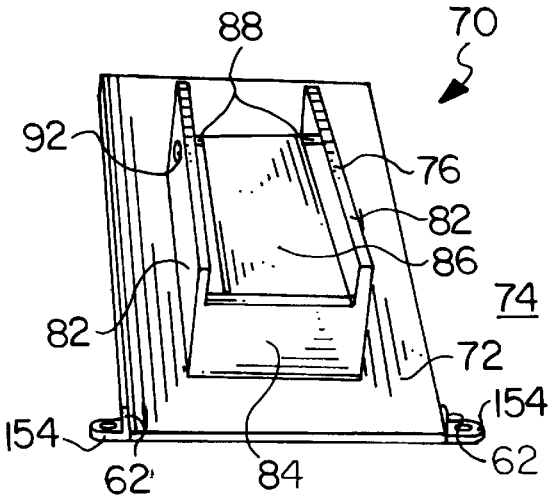
FIG. 6
FIG. 5
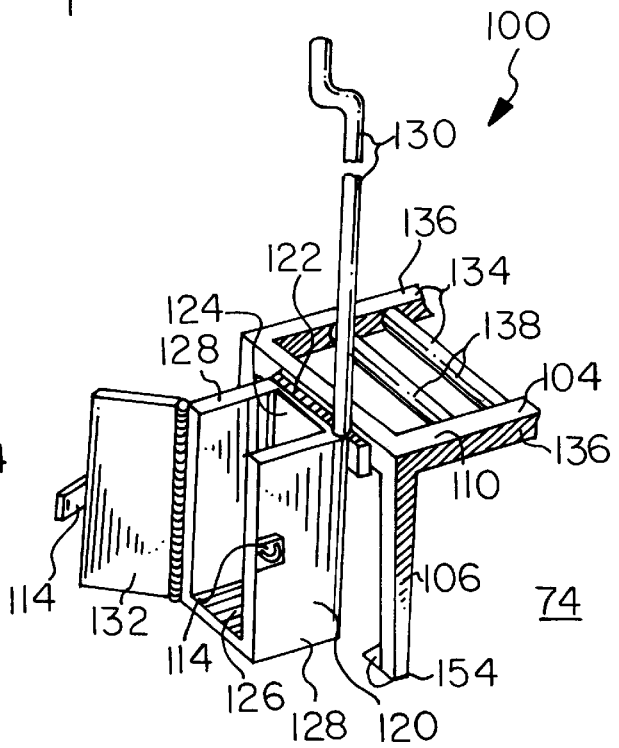

APPARATUS AND PROCESS FOR SAFELY CONTAINING AND DELIVERING HAZARDOUS FLUID SUBSTANCES FROM SUPPLY CYLINDERS AND CYLINDER LOADING STRUCTURE

FILING HISTORY

This application is a continuation-in-part of application Ser. No. 08/901,606 filed on Jul. 12, 1995, now U.S. Pat. No. 5,607,384.

BACKGROUND OF THE INVENTION

1. Field of the Invention

The present invention relates generally to the field of chemical gas and liquid containment and delivery systems. More specifically, the present invention relates to an apparatus and process for safely delivering a hazardous fluid substance such as chlorine gas from a supply cylinder to a receiving structure or system, such as to a gas chlorinator or water process system and serves as secondary containment and otherwise in accordance with government regulations. These regulations specifically include Toxic Gas Ordinance No. 23450, Chapter 17.78 of the San Jose Municipal Code, and the Uniform Fire Code, Article 80, Hazardous Materials.

The apparatus includes a high pressure containment vessel for receiving and safely enclosing a supply cylinder having a release valve and containing a hazardous fluid substance at a pressure above ambient. A high pressure flex line extends from the supply cylinder release valve to an automatic gas sensing valve assembly mounted in a vessel port in the vessel wall. The gas sensing valve assembly automatically shuts off the flow of gas at the vessel port when a gas leak is detected outside the containment vessel, or in the event of seismic activity and power failure. Chlorine gas passes through the valve assembly and into a receiving structure or system, such as a gas chlorinator. A manually operated valve is also provided in series with the automatic gas sensing valve assembly. The sensing valve assembly has a fail-safe-to-close design and the manual containment valve is a standard chlorine industry ton valve. Should the supply cylinder leak, the gas it contains may be released into the process system or chlorinator at a very low controlled rate, and alternatively may be released instead into a gas cylinder rather than scrubbed and wasted.

A cylinder loading structure is provided for loading relatively heavy supply cylinders, such as a 100 pound or a 150 pound supply cylinder, into the high pressure containment vessel. The loading structure includes a containment vessel pivoting assembly for tilting the vessel into a substantially horizontal position, adjacent to and substantially coaxial with the containment vessel so that the cylinder may be longitudinally displaced into the open vessel. The vessel is then pivoted into a more upright position so that only gas is released from the containment vessel upper end. Alternatively, the containment vessel can be positioned to extract liquid.

The delivery process is inventively passive, so that dependence upon electric power for safe containment and flow is eliminated. The process includes the steps of placing a supply cylinder into a containment vessel; connecting the supply cylinder release valve to a tubing means extending through a fluid substance sensing valve assembly in the vessel wall. Optional additional steps include delivery of the fluid substance from the gas sensing valve assembly into a process system or chlorinator. Fluid substance contained within the supply vessel is maintained at ambient temperature so that gas pressure is minimized for safe retention. The distribution cylinder or other receiving structure or system is typically under a vacuum and, in this way the flow of gas results from the pressure differential, rather than from the mechanical action of drive means, so that fluid substance containment and apparatus operation is passive, and high pressures are safely avoided.

2. Description of the Prior Art

There have long been gas delivery and transfer systems for delivering hazardous fluid substances from a supply cylinder, which is typically a 100 pound, 150 pound or ton cylinder, into a receiving structure or process system. Recent government environmental and safety regulations have required that delivery or transfer take place within secondary containment. This has been accomplished in either of two ways.

One way has been to make the transfer in a room with massive and very costly scrubber equipment, so that if a leak develops, all gas in the supply cylinder can be very rapidly scrubbed from the air. This process makes it necessary to shut down operation in the room for one or more days and also results in the loss of all chlorine in the supply cylinder, both of these consequences being very expensive in addition to the cost of the scrubbing equipment. Should leakage take place during a power outage, particularly during a natural disaster, the scrubbing equipment may not function, so that the dangerous chlorine gas would escape into the neighborhood and into nearby ecosystems. Also, if the scrubbing unit fails, the operator would be exposed to extremely high concentrations of chemical.

The other known way of transferring chlorine gas is with the use of what is known as a gas cabinet, which is essentially an ordinary sheet metal cabinet. The supply cylinder is placed inside the gas cabinet. The cabinet has a release port opening into a powerful suction and scrubber assembly. In the event of supply cylinder leakage, the scrubber assembly must be activated immediately to rapidly draw away all of the escaping gas which includes the entire contents of the supply cylinder. The cabinet would not contain the gas in the event that a power failure shut down the scrubber. Thus the problems of the scrubbing room are substantially presented by the cabinet and scrubber containment system.

It is thus an object of the present invention to provide a hazardous fluid substance delivery system which provides the safe secondary containment required by law.

It is another object of the present invention to provide such a system which is compact and which requires minimal shutdown time in the event of a fluid substance leak.

It is another object of the present invention to provide such a system which safely retains any of the fluid substance leaking from the supply cylinder which has not reached the receiving structure or system, for gradual release into process or into a scrubbing unit, or chlorinator.

It is another object of the present invention to provide such a system which can release gaseous substances at a slow, controlled rate and thus requires only a small, low capacity and inexpensive scrubbing assembly.

It is still another object of the present invention to provide such a system which safely and secondarily contains the vast majority of leaking fluid substance in the event of power failure such as during a natural disaster.

It is still another object of the present invention to provide such a system which automatically stops the flow of fluid substance from the containment vessel with a valve operated by a fluid substance sensing mechanism.

It is a further object of the present invention to provide such a system which permits easy and safe loading and unloading of relatively heavy supply cylinders into and out of the containment vessel.

It is a still further object of the present invention to provide such a system which delivers or transfers a fluid substance by passive, low pressure means and which is compact and economical to build and operate.

It is a still further object of the present invention to provide such a system which keeps the operator from being confined within a closed environment, which would subject this operator to extremely high chemical concentrations.

It is finally an object of the present invention to provide an emergency containment vessel for leaking cylinders that are being kept in storage.

SUMMARY OF THE INVENTION

The present invention accomplishes the above-stated objectives, as well as others, as may be determined by a fair reading and interpretation of the entire specification.

An apparatus is provided for safely delivering a hazardous fluid substance to a receiving structure, including a supply cylinder containing a hazardous fluid substance and having a supply cylinder release port; a high pressure containment vessel having a vessel wall and a vessel receiving end, for receiving and safely enclosing the supply cylinder; a conduit structure in fluid communication with the supply cylinder and with the receiving structure for delivering the hazardous fluid substance from the supply cylinder into the receiving structure; and a supply cylinder loading structure for loading the supply cylinder into the containment vessel, including a containment vessel pivoting assembly having a structure for tilting the containment vessel into a substantially horizontal position and a supply cylinder pivoting assembly having a structure for tilting the supply cylinder into a substantially horizontal position for sliding the supply cylinder into the vessel receiving end.

The conduit structure preferably includes a high pressure first tube extending from, and in fluid communication with, the supply cylinder release port to a vessel port in the vessel wall; and a vessel valve in fluid communication with the first tube for controlling delivery of the fluid substance from the supply cylinder and from the vessel. The containment vessel pivoting assembly preferably includes a foot portion platform member for resting on an assembly support surface, and a vessel support structure affixed to the platform member including a vessel pivot pin member and pivot pin member support structure for supporting, rotatably engaging and spacing above the platform member the pivot pin member, and including a vessel engagement member secured to the pivot pin member for supporting and guiding the containment vessel as the containment vessel pivots about the pivot pin member. The height of the pivot pin member above the platform member is preferably substantially equivalent to the height of the center of gravity of the containment vessel above the platform member when the containment vessel is in an upright position, so that the vessel pivots with minimal force. The supply cylinder pivoting assembly preferably includes an assembly support surface; a cylinder support table for supporting the supply cylinder in a substantially horizontal position, where the table is positioned adjacent to the containment vessel pivoting assembly and adjacent to the vessel receiving end, the cylinder support table including at least one support leg, a table top structure, a cylinder pivoting table end directed substantially toward the containment vessel; and a cylinder carriage structure hingedly connected to the pivoting table end with a table hinge for retaining and pivoting the supply cylinder between the support surface and the table top structure.

The cylinder carriage structure preferably includes a pivoting wall connected to the table hinge; a carriage bottom wall resting on the support surface when the carriage structure is pivoted downwardly, two opposing carriage side walls protruding upwardly from the carriage bottom wall and laterally from the carriage pivoting wall and spaced apart a sufficient distance to receive between them the supply cylinder, a pivoting handle extending upwardly from the carriage structure for pivoting the carriage structure and supply cylinder relative to the table. The table top structure preferably includes a roller track including a series of parallel cylindrical rollers for supporting and rolling the supply cylinder along the table top structure with minimal friction resistance. The apparatus preferably additionally includes a pivoting bridge assembly positioned between the containment vessel pivoting assembly and the supply cylinder pivoting assembly for supporting the supply cylinder as the supply cylinder is slid between the table top structure and the containment vessel. The bridge assembly preferably includes a bridge track including a pair of substantially parallel and spaced apart rail members and a series of parallel cylinders extending between and rotatably mounted to the rail members. The assembly rests on an assembly support surface and one rail member of the bridge track is hingedly connected to the bridge support structure to pivot upwardly to a substantially vertical position and downwardly to a substantially horizontal position, additionally including a stop element for stopping and supporting the bridge track in the horizontal position, so that once the cylinder is pivoted upwardly and slid onto the table top structure, the cylinder carriage is pivotable back down to rest on the support surface and the bridge track is pivotable down into the horizontal position.

The vessel valve preferably includes a fluid substance sensing valve assembly mounted in the vessel port, for automatically shutting off the flow of the fluid substance at the vessel port upon detection of the fluid substances outside the containment vessel, seismic activity, power failure, or other alarm activity. The vessel will connect to a fluid substance scrubbing or process of sufficient capacity to scrub all of the fluid substance initially within the supply cylinder at a controlled flow rate through the vessel valve.

BRIEF DESCRIPTION OF THE DRAWINGS

Various other objects, advantages, and features of the invention will become apparent to those skilled in the art from the following discussion taken in conjunction with the following drawings, in which:

FIG. 3 is a side view of the preferred sensing valve assembly on the containment vessel.

FIG. 5 is a perspective, broken away view of the supply cylinder pivoting assembly table pivoting end, showing the carriage in detail.

FIG. 6 is separate, perspective view of the foot portion platform and support box of the vessel pivoting assembly.

DETAILED DESCRIPTION OF THE PREFERRED EMBODIMENTS

Figure 1:
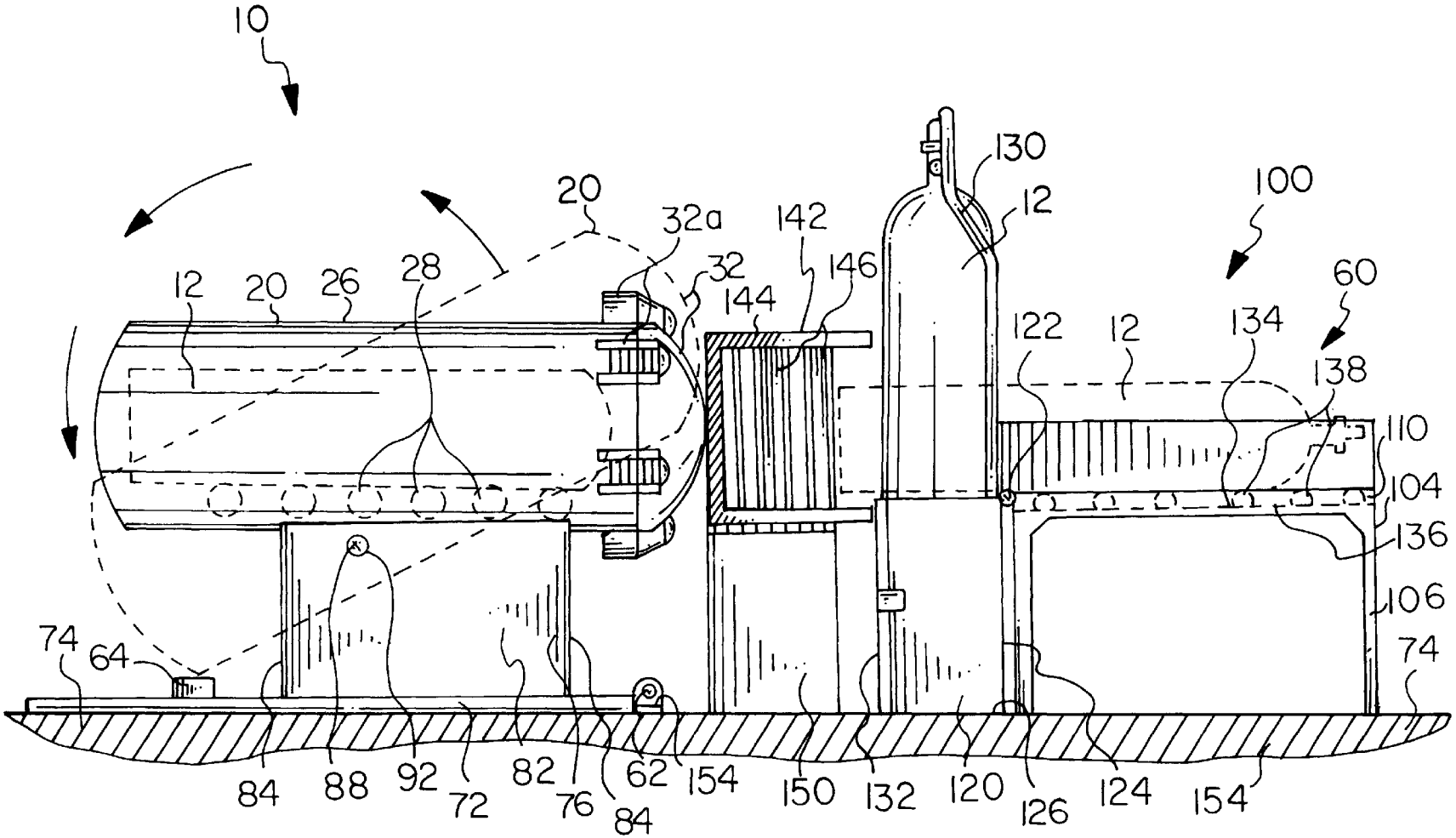
FIG. 1 is a side view of the loading structure of FIG. 6, with a supply cylinder resting in the carriage, and the closest carriage side wall cut away. The supply cylinder is also shown in broken lines inside the containment vessel, and the containment vessel is also shown in broken lines in its angled position.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

Preferred Embodiments

Referring to FIGS. 1–7, an apparatus 10 is disclosed for safely delivering a toxic or otherwise hazardous fluid substance such as ammonia, sulphur dioxide, or chlorine, in gas or liquid form, from a supply cylinder 12 having a release valve 16 to a distribution cylinder or process system (not shown). The word "fluid" in this application is understood to refer to both gaseous and liquid states. Chlorine gas transfer is an example followed throughout this description which is illustrative of the use of apparatus 10, but which should in no way be construed as limiting.

Apparatus 10 includes a high pressure capacity containment vessel 20 for receiving and safely enclosing a supply cylinder 12. A series of wheels 18 mounted on mounting posts 28 within vessel 20 support and permit supply cylinder 12 to roll into vessel 20. A high pressure flex line 22 extends from release valve 16 on supply cylinder 12 to a vessel port 24 in the vessel wall 26 into which is mounted the containment valve 38 and the gas sensing valve assembly 30. Gas sensing valve assembly 30 automatically shuts off the flow of gas through port 24 when a gas leak is detected outside containment vessel 20. Chlorine gas passes through valve assembly 30 to a process system, or one or more distribution cylinders are removably connected.

A manually operated valve 38 is also provided for use in the event of a sensing valve assembly 30 malfunction. Sensing valve assembly 30 has a fail-safe-to-close design. The sensing and containment valve assembly, 30 and 38, is connected to a reduced orifice controller for metering gas release. The reduced orifice controller 36 permit a greatly reduced release rate of gaseous or liquid chlorine. This reduced flow greatly reduces the worse-case release magnitudes. A pressure-vacuum gauge 39 is provided on containment vessel 20 to indicate to an operator when supply cylinder 12 has been totally evacuated.

The vast majority of the gas is automatically sealed within supply cylinder 12 by sensing valve assembly 30. A leak in supply cylinder 12 empties gas into containment vessel 20. This gas can be scrubbed at a low rate because it is safely contained, and can be discharged through the process system. Should power failure deactivate the process or scrubbing unit during a gas leak, the release is negligible in comparison with the prior art release of all the gas in the supply cylinder 12.

Apparatus 10 can also lend itself to a purge system. Containment vessel 20 is evacuated through evacuation valve 52 in vessel wall 26.

Gas sensing valve assembly 30 preferably includes a nitrogen powered, fail-safe-to-close automatic shut-off valve. See FIG. 3. This state-of-the-art, pneumatic-spring unit is designed to interface with multiple control points. The unit is connected to chlorine detectors and/or seismic sensors, and other alarms to provide for immediate chlorine shut off. The unit is hermetically sealed, and all components are NEMA-7. Each of the following events preferably activate the automatic shut-off: (1) gas detection, (2) remote location alarm in a facility housing apparatus 10, (3) failure of emergency power, (4) seismic activity, (5) failure of primary containment, (6) activation of manual fire alarm.

The exhausted enclosure (not shown) is combined with structural seismic support of conventional design directly connected to containment vessel 20. Stationary tanks and piping systems used for regulated materials are seismically braced in accordance with the provisions of the Building Code.

Once again, it is to be understood that chlorine gas is merely one preferred fluid substance, of many gaseous and liquid substances, for delivery or transfer with apparatus 10.

A cylinder loading structure 60 is provided for loading relatively heavy supply cylinders 12, such as a 100 pound or a 150 pound supply cylinder 12, into high pressure containment vessel 20. See FIGS. 1, 2, 4, 5 and 7. Loading structure 60 includes a containment vessel pivoting assembly 70 for tilting vessel 20 between an angled position relative to horizontal with lid 32 elevated, and a substantially horizontal position. The loading structure 60 also includes a supply cylinder pivoting assembly 100 for tilting the supply cylinder 12 from a fully upright position into a substantially horizontal position adjacent to and substantially co-axial with containment vessel 20 so that the cylinder 12 may be longitudinally displaced into vessel 20. The containment vessel 20 is then pivoted into the angled position, preferably a 50 degree position, from horizontal so that only gas is released from the supply cylinder 12 gas release valve 16. Alternatively, containment vessel 20 is maintained in its horizontal position for release of liquid from the vessel 12.

The containment vessel pivoting assembly 70 preferably includes a foot portion platform 72 for resting on a support surface such as a floor 74. Platform 72 includes a pair of hinges 62 at one end and a weight pad 64 at the other end. Platform 72 may take the form of a metal plate having a width greater than the vessel 20 diameter and a length at least as great as the vessel 20 length for maximum assembly 70 stability. A metal vessel support box 76 is affixed to the platform 72 upper surface such as by welds. See FIGS. 1, 2 and 4. Support box 76 has opposing side walls 82 parallel to the long sides of the platform 72 and has opposing end walls 84 parallel to the short sides of the platform 72. End walls 84 are shorter than side walls 82 so that box 76 receives the curved side wall of vessel 20 resting horizontally on top of box 76. A pivoting box top wall 86 is provided on which the vessel 20 rests for supporting and guiding the vessel 20 as it is pivoted. A high strength hinge pin member 88 extends across support box 76 and through pin member bearings 92 in box side walls 82 near one end of box 76. The box top wall 86 is secured to the pin member 88 and not to the box side or end walls, 82 or 84, respectively, so that top wall 86 is free to pivot on pin member 88 relative to box 76. The vessel 20 side wall is removably secured to box top wall 86 with appropriate fastening means. Pin member 88 is located along the longitudinal axis of vessel 20 at a point substantially adjacent to the vessel 20 center of gravity so that vessel 20 pivots with minimal resistance. Vessel 20 rests against the upper ends of the vessel support box side walls 82 and the remote box end wall 84. Alternatively the pin member 88 is positioned slightly below the vessel 20 center of gravity to cause the vessel 20 to be stable in its horizontal rest position on the box 76, and yet to pivot back into the angled position with minimal lifting force. It is anticipated that this tilting of vessel 20 can be accomplished by hand, although the use of hydraulic jacks or other equivalent forms of mechanical assistance is contemplated.

Figure 7:
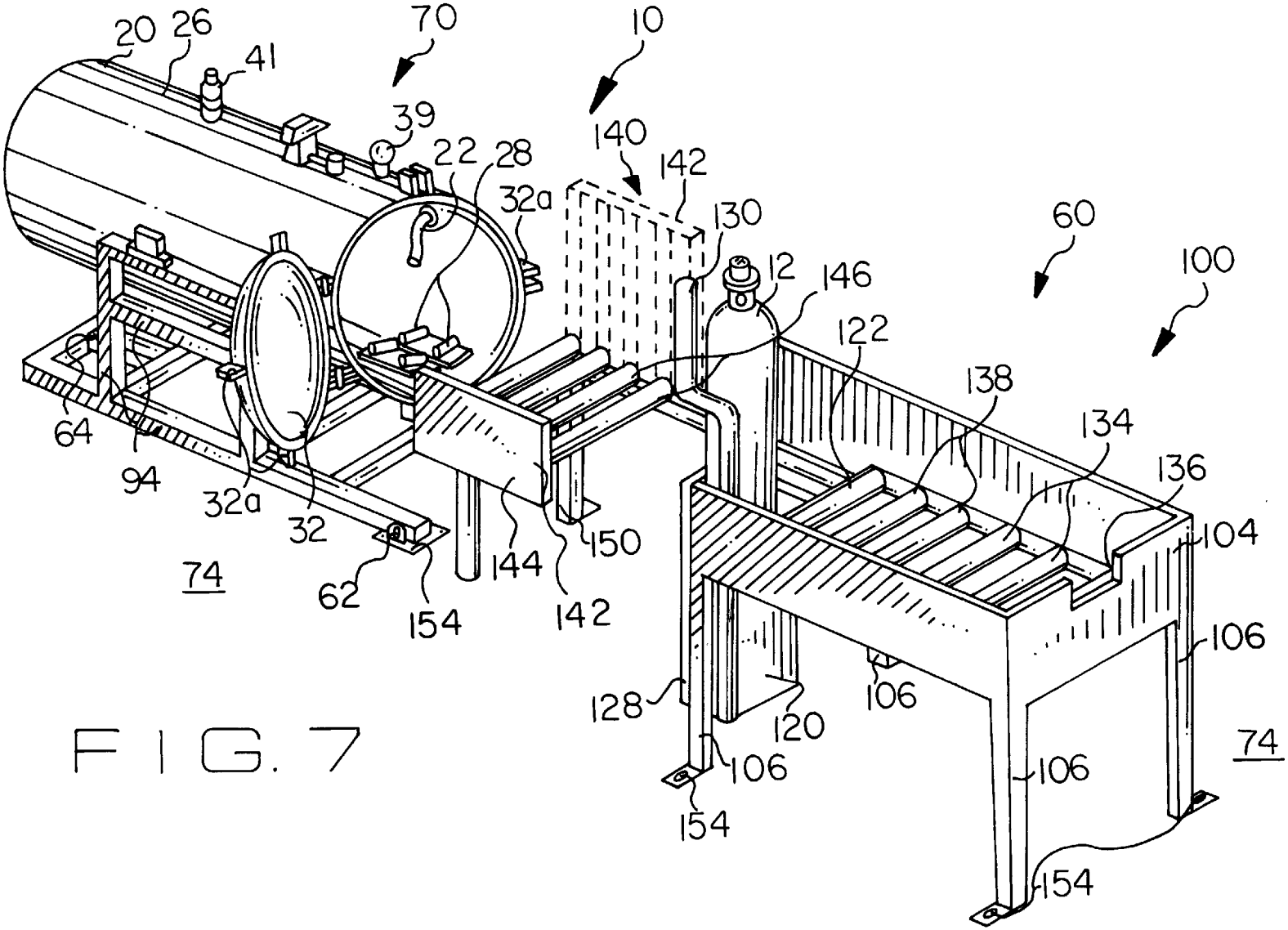
FIG. 7 is a view as in FIG. 4, but showing the preferred containment vessel support frame as an alternative to the vessel support box.

An alternative to box 76 is a frame 94 having parallel and laterally spaced apart side rails 96. See FIG. 7. One of the rails 96 in FIG. 7 is located against the far side of vessel 20 and therefore not visible in this illustration. Pins 98 are welded to the vessel 20 side wall and extend through pin bearings 92 welded onto to tops of side rails 96.

The supply cylinder pivoting assembly 100 preferably includes a cylinder support table 104 for supporting a supply cylinder 12 in a horizontal position. Table 104 is positioned a certain distance from the vessel 20 pivoting assembly. Table 104 is also of a height and orientation such that the longitudinal axis of a cylinder 12 lying on top of table 104 is substantially co-axial with the longitudinal axis of the vessel 20 in its horizontal position.

Table 104 includes four legs 106 and a top member 110, and is of a sturdy construction to safely and reliably support a large supply cylinder 12. One end, hereinafter the table pivoting end 112, of table 104 is directed toward the vessel 20 lid end as the vessel 20 is in its horizontal position. A supply cylinder carriage 120 is connected to table pivoting end by a heavy-duty table hinge 122.

Carriage 120 preferably includes a pivoting wall 124 connected at one end to table hinge 122. See FIGS. 1 and 4. Pivoting wall 124 is of a length substantially equivalent to the table 104 height so that the pivoting wall 124 touches the floor 74 at its free end when pivoted upright. Carriage 120 also includes a carriage bottom wall 126 resting flat on the floor 74 when the carriage 120 is pivoted upright. Two opposing carriage side walls 128 protrude upwardly from carriage bottom wall 126 and laterally from pivoting wall 124, and are spaced apart a sufficient distance to receive between them and on top of carriage bottom wall 126 a large size, upright supply cylinder 12. A pivoting handle 130 extends upwardly from a carriage side wall 128 for operation by a workman. A carriage door 132 preferably extends between carriage side walls 128 opposite pivoting wall 124 and is connected to one side wall 128 with a hinge (not shown), to hold cylinder 12 inside carriage 120 during pivoting. Door 132 has a latch 114.

The table top member 110 includes a table track 134 of conventional design, made up of two parallel and spaced apart side rails 136 interconnected by a series of rotatably mounted cylindrical rollers 138, for minimal resistance sliding of the cylinder 12 on the table top member 110.

Figure 2:
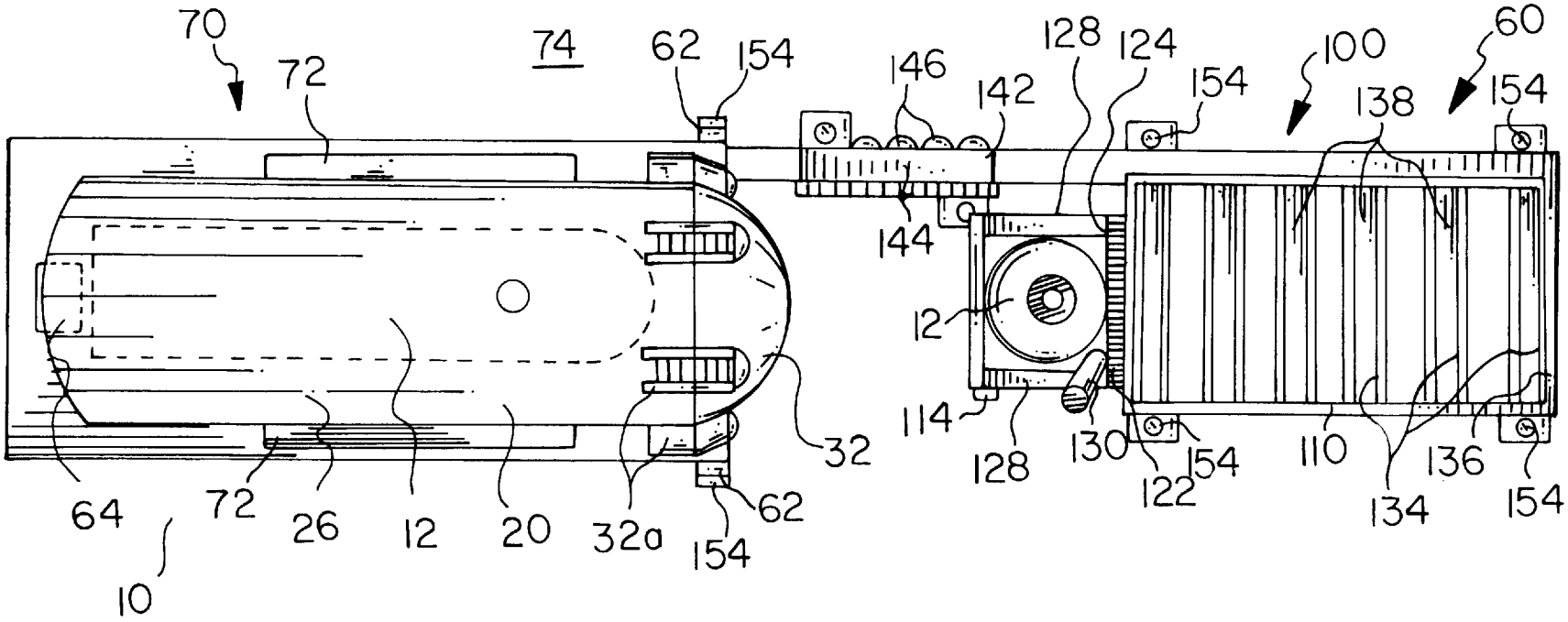
FIG. 2 is a top view of the loading structure and supply cylinder of FIG. 7.
Figure 4:
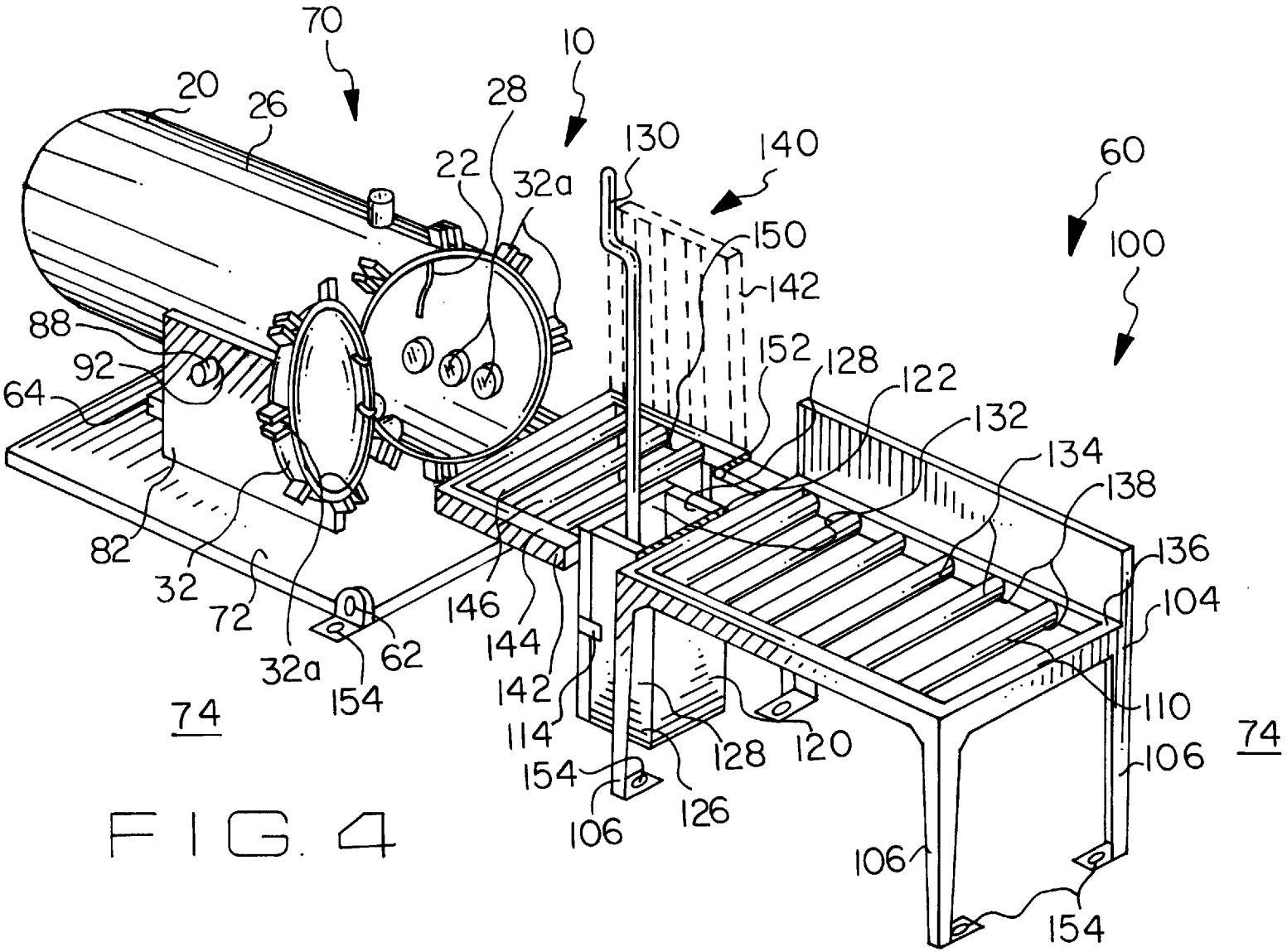
FIG. 4 is a perspective view of the inventive supply cylinder loading structure, with the bridge track in its horizontal, operational position but also shown in broken lines in its vertical, dormant position.

A pivoting bridge assembly 140, see FIGS. 1, 2 and 4, is preferably provided between the vessel pivoting assembly 70 and the cylinder pivoting assembly 100 to help support the cylinder 12 as it is slid from the bridge assembly 140 into the horizontal vessel 20 open end. Bridge assembly 140 includes a roller track segment of conventional design, similar to table track 134. This bridge track 142 is made up of two parallel and spaced apart side rails 144 interconnected by a series of rotatably mounted cylindrical rollers 146. The bridge track 142 is connected along one track rail 144 to an upright support wall 150 with a bridge hinge 152, the support wall 150 extending beside and along the vessel and cylinder pivoting assemblies 70 and 100, respectively, adjacent to the space between the two assemblies. Once the cylinder 12 is pivoted and slid onto table top member 110, the cylinder carriage 120 is pivoted back down to rest on the floor 74 and the bridge track 142 is pivoted down into a horizontal position. Stop elements (not shown) extending from the support wall 150 support bridge track 142 in this horizontal position. The bridge hinge 152 is fastened to the support wall 150 at a level to make the bridge track 142 substantially co-planar with the table track 134. The vessel and cylinder pivoting assemblies 70 and 100, respectively, are preferably secured to the a concrete floor 74 with heavy duty anchor studs 154 to prevent relative movement between the two assembles 70 and 100 and thus to provide greater safety during loading and unloading.

The cylinder loading structure 100 is thus used to deliver a supply cylinder 12 into a containment vessel 20 by: pivoting the vessel 20 on the vessel pivoting assembly 70 into its horizontal position; pivoting the carriage 120 down against the floor 74; placing the cylinder 12 onto the carriage bottom wall 126; closing and latching carriage door 132; gripping handle 130 and pivoting the carriage 120 and cylinder 12 up on so that cylinder 12 rests the table top member 110; sliding the cylinder 12 further onto the table top member 110; lowering the carriage 120 back down into its rest position on floor 74; pivoting the bridge track 142 down into its horizontal position, and sliding the cylinder 12 along the table track 134, over bridge track 142, and into vessel 20 on the vessel internal wheels 28. The cylinder 12 is then connected to the flex line 22 and vessel 20 is closed. Vessel 20 is finally either left in its horizontal position for liquid release or is pivoted into its angled position for gas only release. The loading steps are essentially reversed to unload the cylinder 12 from the vessel 20 when the cylinder 12 contents are fully spent.

Process

In practicing the invention, the following process may be practiced. The process includes the steps of placing a supply cylinder 12 into a containment vessel 20; connecting the supply cylinder 12 gas release valve 16 to a flex line 22 extending through the wall 26 of containment vessel 20 and through gas sensing valve assembly 30. Additional steps optionally include delivering gas into a process system; evacuating the vessel 20 of residual gas; maintaining gas within supply cylinder 12 and within the process system at or below ambient temperature so that gas pressure is minimized for safe retention; the attached process system operating under a vacuum.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. An apparatus for safely delivering a hazardous fluid substance to a receiving structure, comprising:

a supply cylinder containing a hazardous fluid substance and having a supply cylinder release port;

a high pressure containment vessel having a vessel wall and a vessel receiving end, for receiving and safely enclosing said supply cylinder;

conduit means in fluid communication with said supply cylinder release port and with said receiving structure for delivering said hazardous fluid substance from said supply cylinder into said receiving structure;

and a supply cylinder loading structure for loading said supply cylinder into said containment vessel, comprising a containment vessel pivoting assembly having means for tilting said containment vessel into a substantially horizontal position and a supply cylinder pivoting assembly having means for tilting said supply cylinder into a substantially horizontal position for sliding said supply cylinder into said vessel receiving end.

2. The apparatus of claim 1, wherein said conduit means comprises a high pressure first tubing means extending from, and in fluid communication with, said supply cylinder release port to a vessel port in said vessel wall;

and a vessel valve in fluid communication with said first tubing means for controlling delivery of said fluid substance from said supply cylinder and from said vessel.

3. The apparatus of claim 1, wherein said containment vessel pivoting assembly comprises:

a foot portion platform member for resting on an assembly support surface, and a vessel support structure affixed to said platform member including a vessel pivot pin member and pivot pin member support means for supporting, rotatably engaging and spacing above said platform with a pivot pin member, and including cradle means forming a cradle for retaining said vessel while in a substantially horizontal position.

4. The apparatus of claim 3, wherein the height of said pivot pin member above said platform member is substantially equivalent to the height of the center of gravity of said containment vessel above said platform member when said containment vessel is in an upright position, such that said vessel pivots with minimal force.

5. The apparatus of claim 1, wherein said supply cylinder pivoting assembly comprises:

an assembly support surface;

a cylinder support table for supporting said supply cylinder in a substantially horizontal position, wherein said table is positioned adjacent to said containment vessel pivoting assembly and adjacent to said vessel receiving end, said cylinder support table comprising at least one support leg, a table top structure, a cylinder pivoting table end directed substantially toward said containment vessel;

a cylinder carriage structure hingedly connected to said pivoting table end with table hinge means for retaining and pivoting said supply cylinder between said support surface and said table top structure.

6. The apparatus of claim 5, wherein said cylinder carriage structure comprises:

a pivoting wall connected to said table hinge means;

a carriage bottom wall resting on said support surface when said carriage structure is pivoted downwardly, two opposing carriage side walls protruding upwardly from said carriage bottom wall and laterally from said carriage pivoting wall and spaced apart a sufficient distance to receive between them said supply cylinder, a pivoting handle extending upwardly from said carriage structure for pivoting said carriage structure and supply cylinder relative to said table.

7. The apparatus of claim 6, wherein said table top structure comprises a roller track including a series of parallel cylindrical rollers for supporting and rolling said supply cylinder along said table top structure with minimal friction resistance.

8. The apparatus of claim 1, additionally comprising a pivoting bridge assembly positioned between said containment vessel pivoting assembly and said supply cylinder pivoting assembly for supporting said supply cylinder as said supply cylinder is slid between said table top structure and said containment vessel.

9. The apparatus of claim 8, wherein said bridge assembly comprises a bridge track including a pair of substantially parallel and spaced apart rail members and a series of parallel cylinders extending between and rotatably mounted to said rail members.

10. The apparatus of claim 9, wherein said assembly rests on said assembly support surface and one said rail member of said bridge track is hingedly connected to said bridge support structure to pivot upwardly to a substantially vertical position and downwardly to a substantially horizontal position, such that once said cylinder is pivoted upwardly and slid onto said table top structure, said cylinder carriage is pivotable back down to rest on said support surface and said bridge track is pivotable down into said horizontal position.

11. The apparatus of claim 2, wherein said vessel valve comprises a fluid substance sensing valve assembly mounted in said vessel port, for automatically shutting off the flow of said fluid substance at said vessel port upon detection of said fluid substances outside said containment vessel, for automatically sealing substantially all said fluid substance contained within said supply cylinder within said containment vessel in the event of an uncontrolled release of said fluid substance outside said containment vessel.

* * * * *